United States Patent [19]

Gatward

[11] 4,424,926

[45] Jan. 10, 1984

[54] ROLL DISPENSER

[76] Inventor: Douglas K. Gatward, 1212, Great Cambridge Rd., Enfield, Middlesex, England

[21] Appl. No.: 294,294

[22] Filed: Aug. 19, 1981

[30] Foreign Application Priority Data

Aug. 20, 1980 [GB] United Kingdom ..... 8027157

[51] Int. Cl.[3] ..... B65D 85/671

[52] U.S. Cl. ..... 225/26; 225/42; 225/46; 225/53; 225/90

[58] Field of Search ..... 225/42, 46, 53, 25, 225/26, 90; 312/245, 247; 206/464, 461, 468, 467

[56] References Cited

U.S. PATENT DOCUMENTS

| | | | |
|---|---|---|---|
| 302,735 | 7/1884 | Johnson | 225/46 X |
| 1,713,857 | 5/1929 | Rapp | 225/42 |
| 2,606,724 | 8/1952 | Hertz | 225/42 X |
| 2,657,873 | 11/1953 | Dittman et al. | 225/42 X |
| 2,819,851 | 1/1958 | Robertson | 225/90 X |
| 2,990,090 | 6/1961 | Catlett | 225/90 X |
| 3,144,184 | 8/1964 | Yerkes | 225/53 X |
| 3,173,590 | 3/1965 | Bahnsen | 225/42 X |
| 3,739,964 | 6/1973 | Stine | 225/53 X |
| 3,815,801 | 6/1974 | Perrin | 225/53 X |
| 4,252,258 | 2/1981 | Plummer | 225/90 X |

FOREIGN PATENT DOCUMENTS

| | | |
|---|---|---|
| 2632518 | 1/1978 | Fed. Rep. of Germany . |
| 1365349 | 5/1964 | France . |

*Primary Examiner*—Frank T. Yost

*Attorney, Agent, or Firm*—Robert F. O'Connell

[57] ABSTRACT

A roll dispenser 1, preferably one piece having no moving parts, has a rear aperture 8 for insertion of a roll and a front aperture 7 for extraction of material from the roll. A cutter 2 is provided adjacent to the front aperture 7 and a cling surface 3 close to the cutter ensures proper disposition of the material during the retraction. The dispenser is conveniently made by injection moulding, or by compression moulding in which case it is desirable that the top surface 11 and bottom surface 12 are mutually parallel.

6 Claims, 5 Drawing Figures

ROLL DISPENSER

The invention relates to dispensers of rolled sheet material particularly but not enclusively the types suitable for dispensing cling-film wrap, aluminium foil and plastic bags.

Rolls have become particularly useful and popular in kitchens and workshops, as a source of wiping and cleaning materials, covering materials, bags, etc. It is most convenient if the rolls can be held in a fixed dispenser since this leaves both of the user's hands free for the task of removing the desired amount of material from the roll. The dispenser can be provided with a cutting edge to aid removal of the desired length of material, an operation which can be further helped by the provision of suitably spaced lines of weakness across the material. Such lines of weakness will be particularly useful where the roll is a roll of bags and it is essential to sever the roll between the bag sections.

The roll dispensers presently available are broadly of two types. Firstly, there is a very simple dispenser for attachment to a wall and which has two foldable arms, like the arms of a pair of spectacles, with a protrusion on each arm for securing the roll. The arms have resilience, such that they can be forced open to permit the roll to be inserted and engage with the two protrusions, the resilience then holding the roll in place. This type of device can be provided with a cutter, but is more suited to use with a roll of paper towelling having lines of weakness such that a sharp pull is sufficient to remove the desired length of material. The device tends to be rather weak, and it leaves the roll exposed to dirt, grease and dampness.

Another type of device is more sophisticated, and therefore costly. It has a container for a roll and can be attached permanently to a wall. A front flap is provided which is hinged at its lower edge, the hinge being above an aperture for withdrawal of the material from the roll. Below this aperture is provided a coupler blade, which is also hinged to the container. The flap can be opened for replacement of an empty spool by a new roll, and a clip is provided to lock the flap shut. This type of device has several independent parts and each part has a rather complex shape; as a result the device is not susceptible to simple manufacture by inexpensive techniques.

I have now devised a simple roll dispenser which can be made more economically.

According to the present invention there is provided a dispenser for rolled sheet material adapted for removable fixture against a surface, consisting of a one-piece construction having no moving parts comprising a container which can enclose a roll of sheet material, having a first fixed widthwise aperture at the front through which material on the roll can be withdrawn, a cutter integral with the container adjacent to the first aperture for severing from the roll a piece of the material, a second fixed widthwise aperture at the back through which the dispenser can be loaded with a roll, and means for removable fixture to a vertical surface positioned such that in use the vertical surface closes the second aperture.

The two apertures run width-wise of the container and oppose one another. In this way the dispenser can be removably fixed to a wall or other vertical surface such that the second, rear, aperture, is closed by the wall. Any suitable method of removably securing the dispenser to a wall can be employed.

One preferred method for securing the dispenser to a wall is to provide key-hole shaped holes on the dispenser for engagement with screws which have been incompletely screwed into the wall; the larger part of each hole is placed over a screw head and the dispenser moved so that the screws pass into and are held by the narrower parts of the holes. Four such holes can be provided, arranged for example at the corners of a rectangle. The top two key-holes may be vertical with the narrow parts of the holes uppermost so that the weight of the dispenser brings the screws into locking engagement, and the lower two may be horizontal with the narrow parts facing one another so that the sides or other resiliently disposed parts of the dispenser can be forced together to allow the screws through the wide parts and then released so that the sides spring back, bringing the holes into locking engagement. As an alternative to the horizontal key-holes, open holes may be provided at the edges of the dispenser, with the open sides then facing away from each other in the arrangement described. If desired two key-holes only need be provided, in which case they would preferably be oriented obliquely with the narrow parts uppermost and pointing away from each other or towards each other.

Other methods of fixing can be used, and the container may be attached to a horizontal surface or simply may be free-standing.

The new dispenser is suitable for a variety of rolls, for example rolls of cling film (also referred to herein as cling-film wrap), grease proof paper, paper towelling and foil bags. Where cling film is to be used, it may be desirable to provide a cling surface adjacent to the cutter over which surface the film passes from roll to cutter and against which it clings to aid proper disposition of the film: the cling surface can hold the film against the cutter and thus facilitate cutting and withdrawal of a subsequent length of film. The cling surface may run the entire length of the cutter, and is preferably positioned a small distance below the cutting surface. The cling surface preferably has a gap or depressed portion, preferably halfway along its length, to aid retraction of film, for example by thumb and fore finger, from the surface when a further length of material is desired. Moreover, even when not used with cling-film wrap, the presence of such a surface can help in ensuring that the leading end of the material being dispensed is presented to the aperture.

In general, retraction of the cling film or other material can also be facilitated by the provision of openings at the sides of the dispenser and behind the cutter, e.g. by placing the cutter forward of the first aperture. The user of the dispenser can then grasp the material at both edges and lead it out over the cutter.

The dispenser preferably has a sloping floor upon which the roll is intended to rest, with the slope being such as to cause the roll to lie adjacent the first fixed aperture.

The dispenser may be made of any suitable material, but a plastics construction is preferred. Depending on the type of plastics material chosen, manufacture can be by compression moulding, injection moulding or other suitable technique.

The dispenser is a one piece moulding; however, the cutter may be augmented by a separate attachment. If compression moulding is to be used, it is desirable that the top and bottom, as well as the two surfaces of the dispenser, are planar and nearly parallel, since this considerably simplifies manufacture.

The invention will now be further described by way of non-limiting example with reference to the accompanying drawings, in which, FIG. 1 is a front view of a dispenser;

Figure 1:
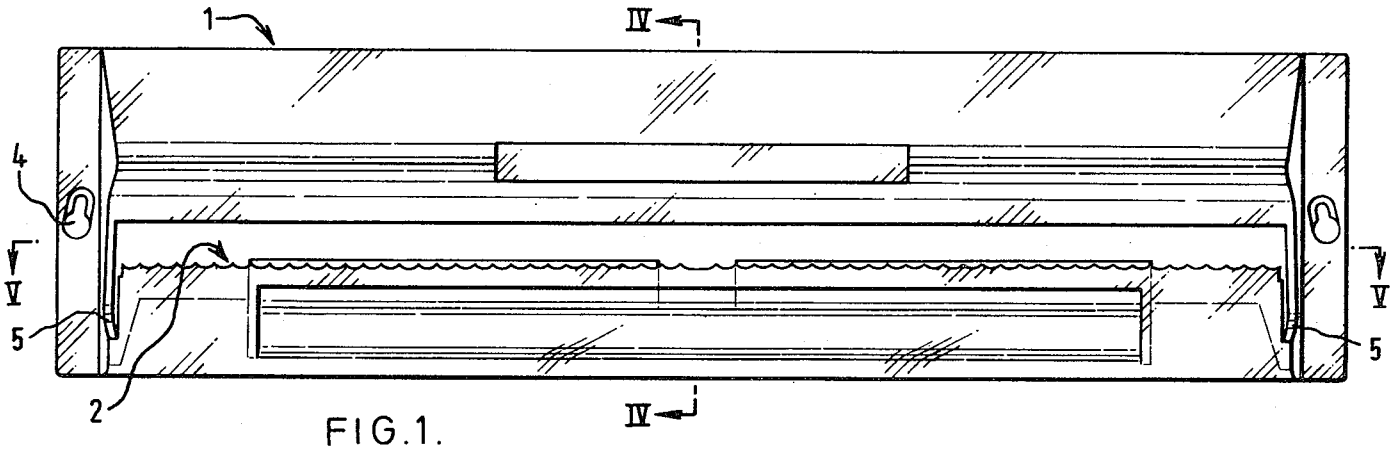
Figure 2:
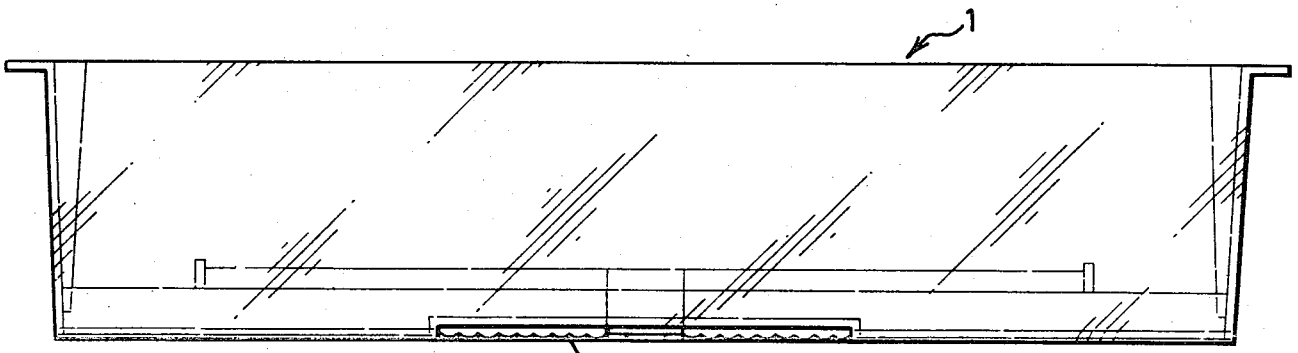
FIG. 2 is a plan of the dispenser.
Figure 4:
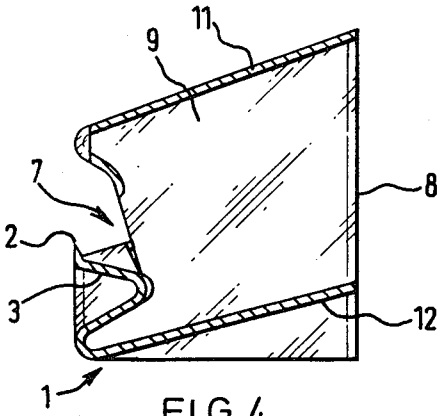
FIG. 4 is a transverse cross-section of the dispenser.
Figure 3:
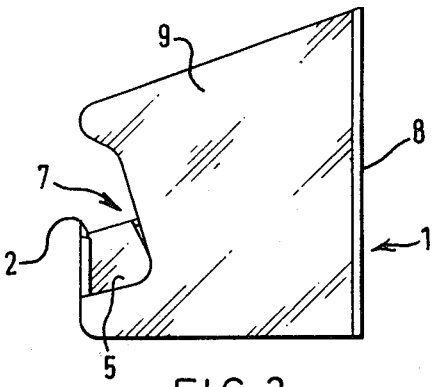
FIG. 3 is an end elevation of the dispenser.
Figure 5:
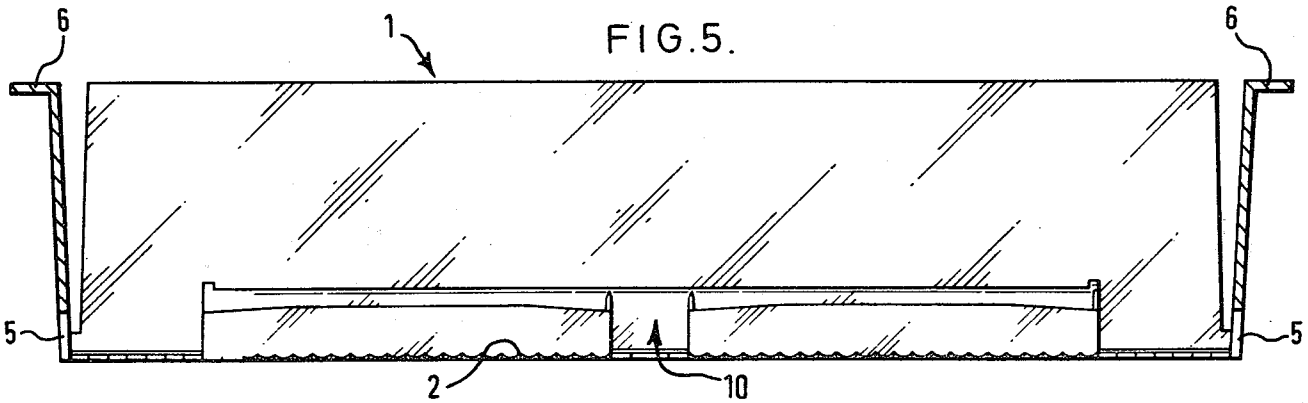
FIG. 5 is a longitudinal cross-section of the dispenser.

The drawings show the following features: a container 1 has an integral cutting edge 2 adjacent to a cling surface 3; obliquely-oriented key-hole shaped holes 4 are provided for attachment of the dispenser to a wall, the holes being provided in resilient flanges 6 at the dispenser sides in order that the holes can be engaged with raised screw-heads in the wall; at the front is an aperture 7 through which material from a roll can be withdrawn, and at the back an aperture 8 is provided for loading of the roll into space 9; a gap or depression 10 in the cling surface 3 and side apertures 5 enable the user to extract film or other material from behind the aperture 7 and lead it out over the cutter 2 which is placed forward of the aperture 7. It can be seen from FIG. 4 that the top surface 11 and bottom surface 12 of the container are substantially parallel to one another, with the bottom surface 12 acting as a sloping floor causing an inserted roll to lie adjacent the aperture 7. The side walls of the dispenser are also substantially parallel, though the divergence from parallelism is greater than for the top and bottom surfaces. Overall the dispenser thus has a slight concity, thereby facilitating demoulding. The dispenser illustrated is a preferred embodiment which is a plastics construction.

I claim:

1. A dispenser suitable for rolled cling film, adapted to be removably attached to a vertical surface consisting of a one-piece construction having no moving parts comprising a container 1 which can enclose a roll of cling film, said container having a first fixed widthwise aperture 7 at the front through which material on the roll can be withdrawn, an upwardly-directed cutter 2 integral with the container 1 adjacent the first aperture 7 for severing from the roll a piece of the film, a second widthwise aperture 8 at the back through which the dispenser can be loaded with a roll and means 4,6 for removably attaching the dispenser to a vertical surface positioned such that, in use, the vertical surface closes said second aperture 8 characterized in that there is means defining a planar surface 3 adjacent to and behind the cutter 2, the plane of which is disposed at an angle to the plane of the cutter 2 to which an end portion of the film between the roll and the cutter is adapted to cling prior to withdrawal for severing for holding the end portion of the film properly positioned to be grasped for withdrawal and severing and from which it can be released for withdrawal and severing.

2. A dispenser according to claim 1, in which the means for removably attaching is one or more key-hole shaped holes, suitable for engagement with raised screw heads.

3. A dispenser according to claim 2, having two key-hole shaped holes oriented obliquely with their narrow parts uppermost, parts of the dispenser being resiliently deformable such that the two holes can be moved towards or away from one another and released for engagement of the holes with raised screw heads.

4. A dispenser according to claim 1 wherein the cling surface 3 has a gap 10 to aid in withdrawing the film from the dispenser.

5. A dispenser according to claim 4 further characterized in that the first aperture 7 extends into the sides of the dispenser behind and adjacent to the cutter to facilitate withdrawal of material from the dispenser.

6. A dispenser according to claim 1 further characterized in that the first aperture 7 extends into the sides of the dispenser behind and adjacent to the cutter 2 to facilitate withdrawal of the material from the dispenser.

* * * * *